United States Patent [19]

Buj

[11] Patent Number: 4,863,033

[45] Date of Patent: Sep. 5, 1989

[54] SET OF EATING UTENSILS FOR CHILDREN

[76] Inventor: Elena G. Buj, 105 Carretera General, Hermigua (Gomera) Tenerife, Spain

[21] Appl. No.: 211,334

[22] Filed: Jun. 24, 1988

[30] Foreign Application Priority Data

Jul. 1, 1987 [ES] Spain ..... 8702216

[51] Int. Cl.[4] ..... A47G 19/06

[52] U.S. Cl. ..... 206/541; 206/457; 220/85 D; 30/123; D7/3; D7/5

[58] Field of Search ..... 220/212, 85 D; 206/553, 206/457, 541, 542, 546, 549; 30/1, 123; D7/3, 5, 143, 144

[56] References Cited

U.S. PATENT DOCUMENTS

| | | | |
|---|---|---|---|
| D. 155,948 | 11/1949 | Weeber | D7/5 |
| 4,534,469 | 8/1985 | Elsmo | 206/553 X |
| 4,779,344 | 10/1988 | Panish | D7/143 X |

*Primary Examiner*—John Fox

*Attorney, Agent, or Firm*—Collard, Roe & Galgano

[57] ABSTRACT

A set of eating utensils for children in which a plate with a toy figure attached thereto is provided. The plate includes a plurality of pegs so that a spoon, fork or knife may be mounted thereon. Each of the spoon, fork or knife has an identical or complementary toy figure removably attached to the handle of the implement. The toy figures are chosen to encourage the children to eat the food on the plate and thereby develop the coordination necessary for proper eating.

6 Claims, 1 Drawing Sheet

SET OF EATING UTENSILS FOR CHILDREN

BACKGROUND OF THE INVENTION

The invention relates to a set of eating utensils for children which consists of a plate and a set of cutlery, including a spoon and fork, and optionally, a knife. Specifically, the invention relates to eating utensils that have been designed to facilitate the feeding of children, especially those who have a poor appetite, although these utensils may be used by children in general as they give all children the chance to enjoy their food and to turn eating into play.

2. Description of the Prior Art

There are a large number of children who are reluctant to eat the food presented to them. Obviously, this causes problems when it comes to feeding these children and makes feeding them a slow and difficult task. Often parents have to resort to telling stories to amuse the children or employ other alternatives to offset their wholly passive attitude towards food and to get them to eat.

It is well known to use special plates, forks, cups and spoons that seek to be more attractive to the child to solve this problem. For example, brighter colors and various shapes other than the conventional ones are used. As any parent knows, these solutions usually are not very satisfactory since any interest in eating they arouse in the child, is minimal and quickly fades.

The eating utensils of the present invention provide a solution for this problem because, apart from carrying out their basic function, the utensils are real toys that enable the children to enjoy themselves while eating. Thus, on the one hand, these utensils help overcome the problems concerning lack of appetite and, on the other hand, encourage the children to eat on their own.

SUMMARY OF THE INVENTION

It is an object of the invention to provide a set of eating utensils for children which encourage them to eat the food presented to them and to develop the coordinated movements necessary for proper eating.

It is a further object of this invention to provide a plate, spoon, fork and knife, each having a complementary or identical toy figure thereon designed to encourage eating.

It is yet an additional object of this invention to provide a set of utensils which can be economically made and which can be assembled into one unit and hung on a wall when not in use.

Accordingly, these objects are achieved by a set of eating utensils for children in which a plate having a toy figure mounted thereon is provided. A spoon, fork and knife are provided, each having a complementary or identical toy figure mounted thereon. The plate has a plurality of bulbous connecting elements or pegs around the periphery thereof which are captured within openings in the handles of each of the spoon, fork and knife. Thus, the spoon, fork and knife may be attached to the plate when not in use by inserting the extension elements within the openings in their handles. The plate also has a hook so that the assembly may be hung on the wall.

The set of eating utensils taught by the present invention includes cutlery which has the traditional shape as far as the spoon, fork or knife blade are concerned, and adopts a specific design for their handles. This design consists of any kind of ornamental device that turns the eating utensil into a toy. The plate can also adopt a shape complementary to the ornamental design or toy that appears on the handle of the spoon, fork or knife.

The eating utensils may be made of any suitable material, such as stainless steel, wood, non-toxic plastic, rubber, etc. Each eating utensil, including the plate, is made of one piece, including its corresponding ornamental figure. Conversely, these ornamental figures may be removable, independent items made from the same or different material as the eating utensils or the plate. The toy figures may be attached to the latter by means of any conventional method, such as a dovetail joint, or a screw, or by clamping, etc.

Another feature of the present invention is that the eating utensils, whatever the shape of the toy connected to or inserted in the end of its handle, has been provided with a system for attaching it to the plate. The plate incorporates at least two suitable points bulbous connection elements or pegs capable of fitting into corresponding holes in the cutlery handles. However, the pegs can obviously be placed on the cutlery handles and the rim or the edge of the plate can be the place where the holes are incorporated.

In any case, according to the present invention, not only is there provided a visually attractive set of utensils from a child's point of view, but also a set of eating utensils that encourage children to handle them. This tendency can be properly directed by the person in charge, with little effort, in order to help develop the coordinated movements necessary for bringing the food into the child's mouth.

Other objects and features of the present invention will become apparent from the following detailed description considered in connection with the accompanying drawing. It is to be understood, however, that the drawing is designed as an illustration only and not as a definition of the limits of the invention.

BRIEF DESCRIPTION OF THE DRAWING

In the drawing, where similar reference numerals denote similar elements throughout the several views.

DESCRIPTION OF THE PREFERRED EMBODIMENT

Figure 1:
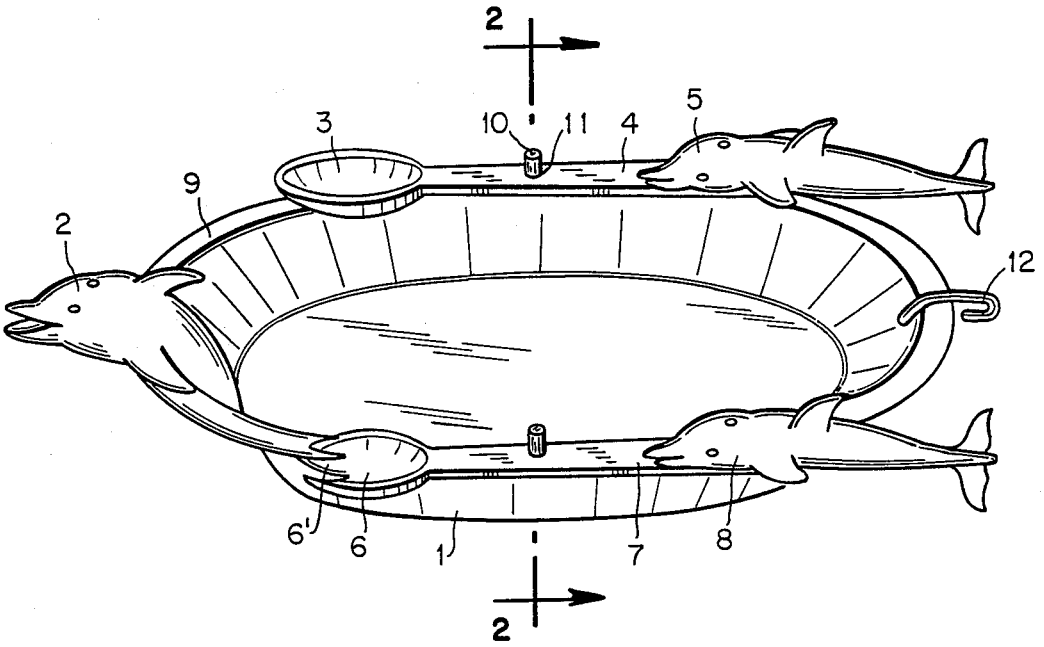
FIG. 1 is a perspective view of a set of eating utensils for children having the design of the present invention, consisting of a plate, a spoon and a fork.
Figure 2:
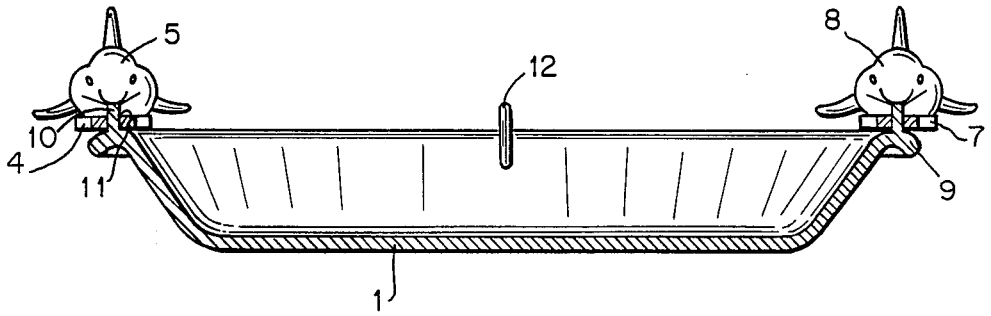
FIG. 2 is a cross-sectional view of the utensils as set forth in FIG. 1 along lines 2—2.

Referring to FIGS. 1 and 2, there is shown a set of food utensils for children consisting of a plate 1 which may be of any shape attractive to a child, and which allows the introduction of an ornamental FIG. 2 in an appropriate place where it does not interfere with the placing of the food. This figure may be a dolphin, as represented in FIG. 1 or any other "toy". A spoon 3, provided with a standard end having a structural concavity and size suited to its practical function, includes on an end or empty edge of its handle 4 another toy or ornamental figure identical to or complementary with the already existing figures on plate 1. In addition, a similar structure is established for the fork 6, whose prongs 6' are able to adopt any suitable shape limited such that this utensil can still perform its function and whose handle 7 ends with a toy 8. These structural features could be provided for a knife as well, although a knife is not shown in the figures.

As previously discussed, the ornamental FIGS. 2, 5 and 8 may be integrated with the utensil they are associated with (i.e., with the plate 1, the spoon 3 or the fork 6). FIGS. 2, 5 and 8 can be physically separate from the utensils and attached to the latter through any conventional means, such as a dovetail joint, screws or a clamp.

Furthermore, it is possible to make these utensils and ornamental figures from any suitable material and they can be manufactured in one or many colors. Thus, any or all the elements making up the utensils can have the same or different colors, i.e., for the plate, spoon, fork and knife, or the ornamental figures or "toys" connected with them.

Finally, it has been found to be advantageous to make the entire set aesthetically pleasing by making all the pieces assemblable into an ornamental unit that can be displayed when the set is not in operation. To this end, the items of cutlery may be attached to plate 1, particularly to the peripheral rim 9 on the edge of the plate. To facilitate this, peg elements 10 can be inserted into the holes 11 on the utensil handles 4 and 7, so that the latter can be attached to the plate in a simple operation. In addition, each plate has a hook-like extension 12, which allows for the wall support of the entire assembly when not in use.

Although the ornamental FIGS. 2, 5 and 8 consist of dolphins in the embodiment shown in FIGS. 1 and 2, it is obvious that such figures may represent any other animal or object. Whichever is used, with the help of these tools it is possible to influence the child so that, with little effort, he or she can use the utensils as if they were the toys they represent, taking the food from the plate and bringing it to his/her mouth. This makes the feeding of reluctant children much easier and helps the child to learn the movements necessary for feeding him or herself.

While several embodiments and examples of the present invention have been described and/or shown, it is obvious that many changes and modifications may be made thereunto, without departing from the spirit and scope of the invention.

What is claimed is:

1. A set of eating utensils for children comprising:

a plate having a toy figure mounted thereon;

a plurality of pegs formed on a peripheral rim of said plate;

a spoon and a fork, each having a toy figure complimentary to said toy on said plate attached to a respective handle of each of said spoon and fork, each of said spoon and fork having means for capturing one of said plurality of pegs on said plate for mounting said spoon and fork on said plate.

2. The set of eating utensils set forth in claim 1 wherein said toy figure is permanently attached to said handle of said spoon and fork.

3. The set of eating utensils as set forth in claim 1 wherein said toy figure on said plate is identical to said toy figure on each of said spoon and fork.

4. The set of eating utensils as set forth in claim 1 wherein said means for capturing said plurality of pegs on said handle of said spoon and fork are holes formed in each of said handles.

5. A set of eating utensils as set forth in claim 1 wherein said toy figures are multi-colored.

6. A set of eating utensils as set forth in claim 1 wherein said plate includes means for attaching said plate to a wall.

* * * * *